US006331025B1

(12) United States Patent
Douglas

(10) Patent No.: US 6,331,025 B1
(45) Date of Patent: Dec. 18, 2001

(54) BARRIER LIFTER

(76) Inventor: William E. Douglas, R.D. No. 1, Box 151A, New Florence, PA (US) 15944

( * ) Notice: Subject to any disclaimer, the term of this patent is extended or adjusted under 35 U.S.C. 154(b) by 8 days.

(21) Appl. No.: 09/615,324

(22) Filed: Jul. 12, 2000

(51) Int. Cl.[7] ..... B66C 1/44
(52) U.S. Cl. ..... 294/110.1; 294/118; 294/902
(58) Field of Search ..... 294/106, 110.1, 294/110.2, 117, 118, 119, 902

(56) References Cited

U.S. PATENT DOCUMENTS

| | | | | |
|---|---|---|---|---|
| D. 340,792 | | 10/1993 | Lacey . | |
| D. 344,961 | | 3/1994 | Kallen . | |
| D. 354,605 | | 1/1995 | Lucky, Sr. . | |
| D. 408,609 | | 4/1999 | Oja et al. . | |
| D. 425,528 | | 5/2000 | Lindgren et al. . | |
| 2,229,359 | * | 1/1941 | York | 294/118 |
| 2,337,177 | * | 12/1943 | Breslav | 294/110.1 X |
| 2,384,396 | * | 9/1945 | Peyer | 294/110.1 |
| 3,359,033 | | 12/1967 | Curtis . | |
| 3,397,907 | | 8/1968 | Trowbridge . | |
| 3,674,302 | * | 7/1972 | Mutch | 294/118 |
| 4,262,952 | * | 4/1981 | Bradley | 294/110.1 X |
| 4,545,609 | * | 10/1985 | Pasquazzi et al. | 294/106 X |
| 5,056,845 | * | 10/1991 | Cook | 294/118 |
| 5,364,147 | * | 11/1994 | Dickey et al. | 294/117 X |
| 6,012,752 | | 1/2000 | Douglas . | |

FOREIGN PATENT DOCUMENTS

| | | | | |
|---|---|---|---|---|
| 236296 | * | 6/1986 | (DE) | 294/110.1 |
| 564101 | * | 9/1944 | (GB) | 294/110.1 |
| 1255671 | * | 12/1971 | (GB) | 294/110.1 |
| 573434 | | 10/1977 | (SU) . | |
| 787338 | | 12/1980 | (SU) . | |
| 906897 | | 2/1982 | (SU) . | |

* cited by examiner

*Primary Examiner*—Johnny D. Cherry
(74) *Attorney, Agent, or Firm*—Richard C. Litman

(57) ABSTRACT

A barrier lifter apparatus comprising a scissors structure having L-shaped clamping elements, a pair of L-shaped tongs, a bar connecting each of the tongs, a pair of linking elements, rods connecting the pair of tongs and the linking elements, and an apertured plate on the rod between linking elements for hoisting. The apparatus can be either semi-automatic with a latched handle or automatic with a ratcheting-cam action device.

5 Claims, 3 Drawing Sheets

BARRIER LIFTER

BACKGROUND OF THE INVENTION

1. Field of the Invention

The present invention relates generally to a scissors gripping device. More specifically, the invention is a suspended gripping device having either an automatic or a semi-automatic mode for lifting and carrying concrete road barriers.

2. Description of the Related Art

The related art of interest describes various lifting devices, but none discloses the present invention. There is a need for a (1) semi-automatic mode or (2) a fully automatic gripping mode for a lifting device which allows for (1) manual lifting of the handle and (2) hands-free concrete barrier movement.

The relevant art will be discussed in the order of perceived relevance to the present invention.

U.S. Pat. No. 6,012,752 issued on Jan. 1, 2000, to William E. Douglas describes a concrete pipe lifting apparatus with lockable and releasable scissors grip structure, ribbed tongs, and a one-piece handle and latch assembly that a workman can handle safely. The apparatus is distinguishable for requiring ribbed tongs and a one-piece handle and latch assembly.

U.S. Pat. No. 3,359,033 issued on Dec. 19, 1967, to William I. Curtis describes a fluid powered tongs comprising a single acting hydraulic cylinder and motor to move pulley means to tension a cable connected to the tongs to cause them to open. No hydraulic means closes the tongs which close by the weight of the load. The tongs are distinguishable for requiring hydraulic opening means.

U.S. Pat. No. 3,397,907 issued on Aug. 20, 1968, to Clarence D. Trowbridge describes a slab handling device comprising a pair of tongs with upright rods attached to the jaw bodies. The device is distinguishable for requiring upright rods on the jaw bodies intersecting with the joints of the links.

Soviet Union Patent Application No. 573,434 published on Oct. 18, 1977, for Tobolsk River Port describes a pincer grab device for handling building blocks. The device has a linkage with two intersecting rods pivotally mounted on two L-shaped pincers. A hydraulic cylinder connects one pincer element to a link member. The device is distinguishable for requiring a hydraulic cylinder and two rods (4) for joining opposite pincers.

U.S. Design Pat. No. 344,961 issued on Mar. 8, 1994, to Karl-Gustave Kallen describes a timber lifting fork apparatus comprising two opposing forks having different structures. The apparatus is distinguishable for its dissimilar structure.

U.S. Design Pat. No. 354,605 issued on Jan. 17, 1995, to Bobby D. Lucke, Sr. describes a grappler apparatus comprising four separate grappling arms. The apparatus is distinguishable for its different structure.

U.S. Design Pat. No. 408,609 issued on Apr. 20, 1999, to Hannu Oja et al. describes a four-armed device which is distinguishable for its four separate arms structure.

U.S. Design Pat. No. 425,528 issued on May 23, 2000, to Gunnar Lindgren et al. describes a universal gripper apparatus for a wheel loader comprising one tong having a locking mechanism. The apparatus is distinguishable for its different clamping structure.

U.S. Design Pat. No. 340,792 issued on Oct. 26, 1993, to William O. Lacey describes a right-angled and spring-loaded grabbing and hoisting tong comprising a pivoting element positioned in a median position and crossed springs positioned above the median pivoting element. The hoisting tong is distinguishable for its spring action.

Soviet Union Patent Application No. 787,338 published on Dec. 15, 1980, for Kholodoviya describes a pincer grip apparatus with L-shaped pincers pivoting on a frame. Twin-arm levers pivot on the upper ends of the pincers and on the ends of the horizontal arms which have a spring and a gripping plate. The apparatus is distinguishable for its spring-loaded pincer grip structure.

Soviet Union Patent Application No. 906,897 published on Feb. 28, 1982, for Titanium Research Institute describes a grabbing apparatus for cooling transported goods comprising a coolant chamber in a frame with valves fixed in the lower section of the frame. The apparatus is distinguishable for its required coolant chamber.

None of the above inventions and patents, taken either singularly or in combination, is seen to describe the instant invention as claimed. Thus, a barrier lifter which requires less manual handling or none is desired.

SUMMARY OF THE INVENTION

The present invention is a suspended gripping device having either an automatic mode or a semi-automatic mode for lifting and carrying concrete road barriers.

Accordingly, it is a principal object of the invention to provide a gripping device for lifting and transporting concrete road barriers.

It is another object of the invention to provide a gripping device having a scissors movement.

It is a further object of the invention to provide a gripping device having a semi-automatic mode in manually releasing its grip.

Still another object of the invention is to provide a gripping device having in an automatic mode a racheting-cam action which allows for hands-free barrier movement.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
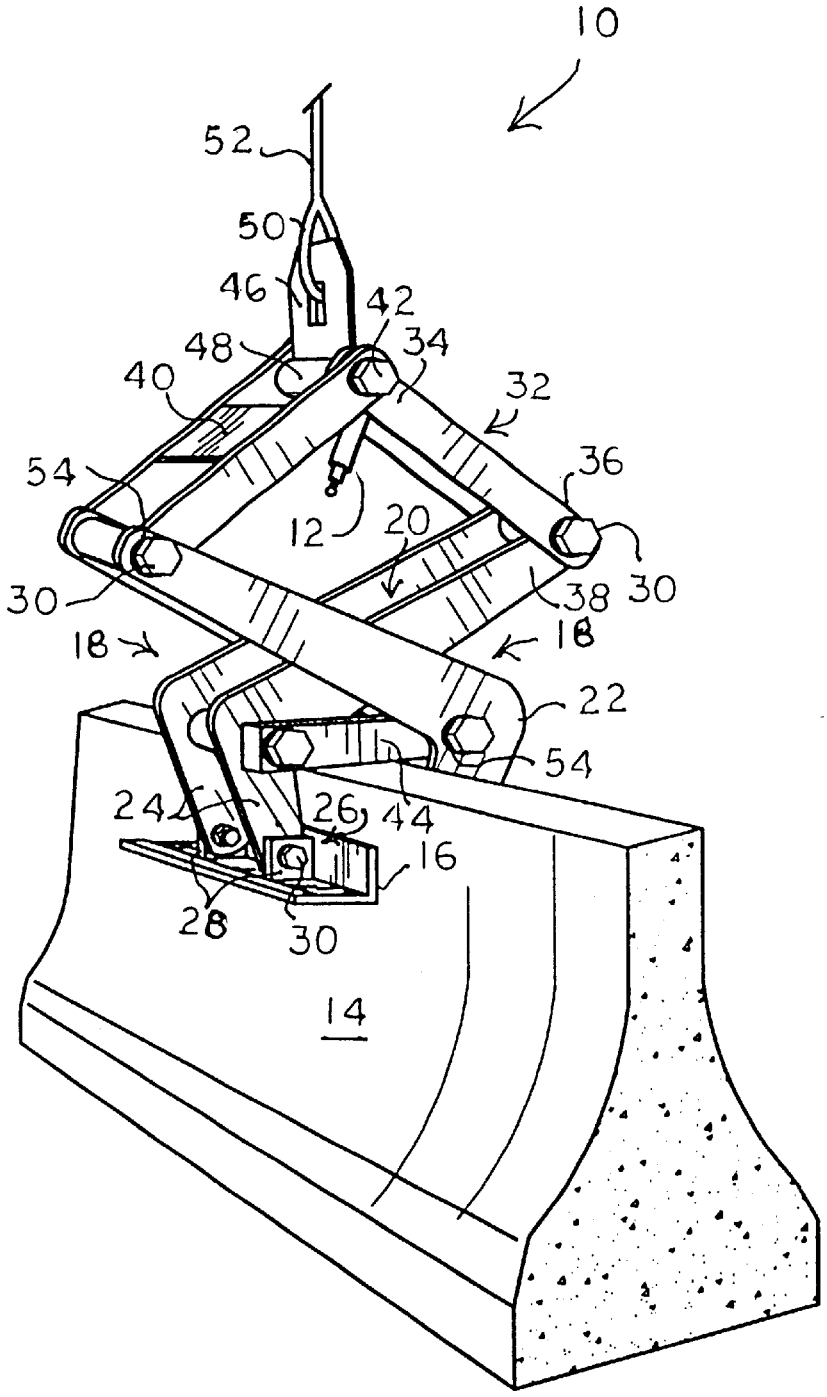
FIG. 1 is an environmental, perspective view of a first embodiment of a fully automatic barrier lifter apparatus hoisting a concrete barrier according to the present invention.
Figure 2:
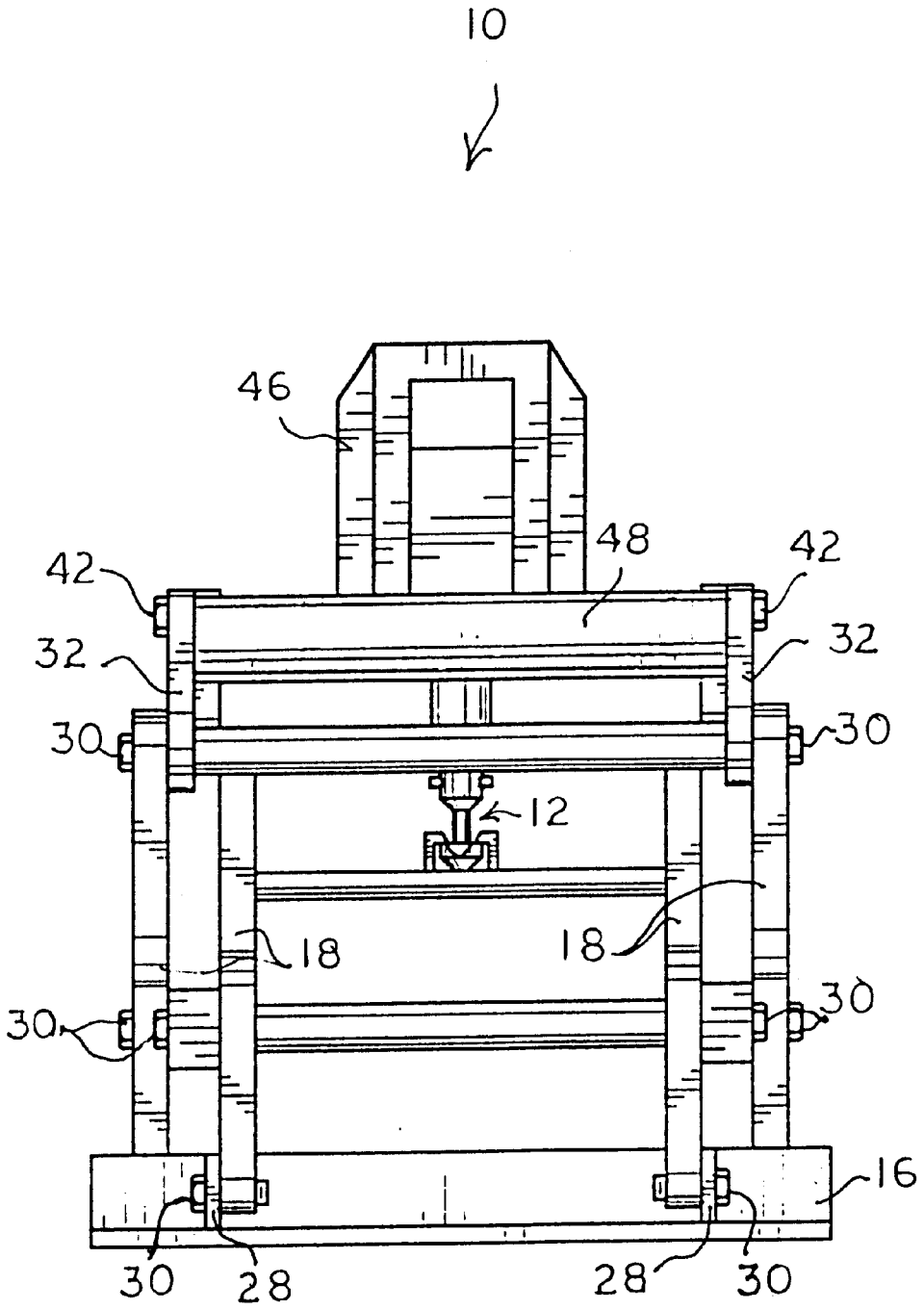
FIG. 2 is a front elevational view of the FIG. 1 barrier lifter apparatus showing the automatic actuator device.

The present invention is directed to a barrier lifter apparatus 10 illustrated in FIGS. 1 and 2 and drawn to a first embodiment including a fully automatic actuator device 12. A concrete barrier 14 is being lifted in FIG. 1. A pair of right-angled jaw elements 16 are positioned horizontally to abut and grip the concrete barrier 14 with one side thereof securely for lifting. A pair of L-shaped tong members 18, wherein each tong member has a long leg 20, a juncture 22 and a short leg 24, has its distal end 26 pivotally connected to lugs 28 by fasteners 30 to each of the right-angled jaw elements 16. This arrangement allows the jaw element 16 to frictionally adapt to any inclination of the surface of the concrete barrier being grasped.

Two pairs of straight link members 32, each having a proximate end 34 and a distal end 36, are pivotally connected at its distal end 36 to the proximate end 38 of each L-shaped tong member 18. Planar cross braces 40 are provided between each pair of the members 32. Each proximate end 34 and distal end 36 of a link member is joined and connected by a pivot pin 42. A pair of crossbars 44 are attached pivotally between each juncture 22 of each tong member 18, wherein one end of each crossbar 44 is positioned outside one juncture 22 and the opposite end is positioned inside the other juncture 22. The crossbars 44 are critical to the gripping function of the tong members 18.

An apertured plate or shackle 46 with a cylindrical end 48 pivots on the pivot pin 42 joining the proximate ends 34 of each link member 32. A clevis 50 and cable 52 provide the lifting function. All the fasteners 30 have welded washers 54.

The actuator device 12 depending from the cylindrical end 48 of the shackle 46 provides a ratchet and cam action of the actuator device for locking the apparatus in an open position. Therefore, in the fully automatic mode, the lifter apparatus 10 is latched by the actuator device 12 in an open position ready to lower onto the concrete barrier 14. When the lifter apparatus 10 contacts the barrier 14, the actuator device 12 automatically releases its hold and the barrier 14 can be lifted for movement. When the barrier 14 is placed on the ground, the actuator device 12 relatches when the apparatus 10 is fully collapsed.

Figure 3:
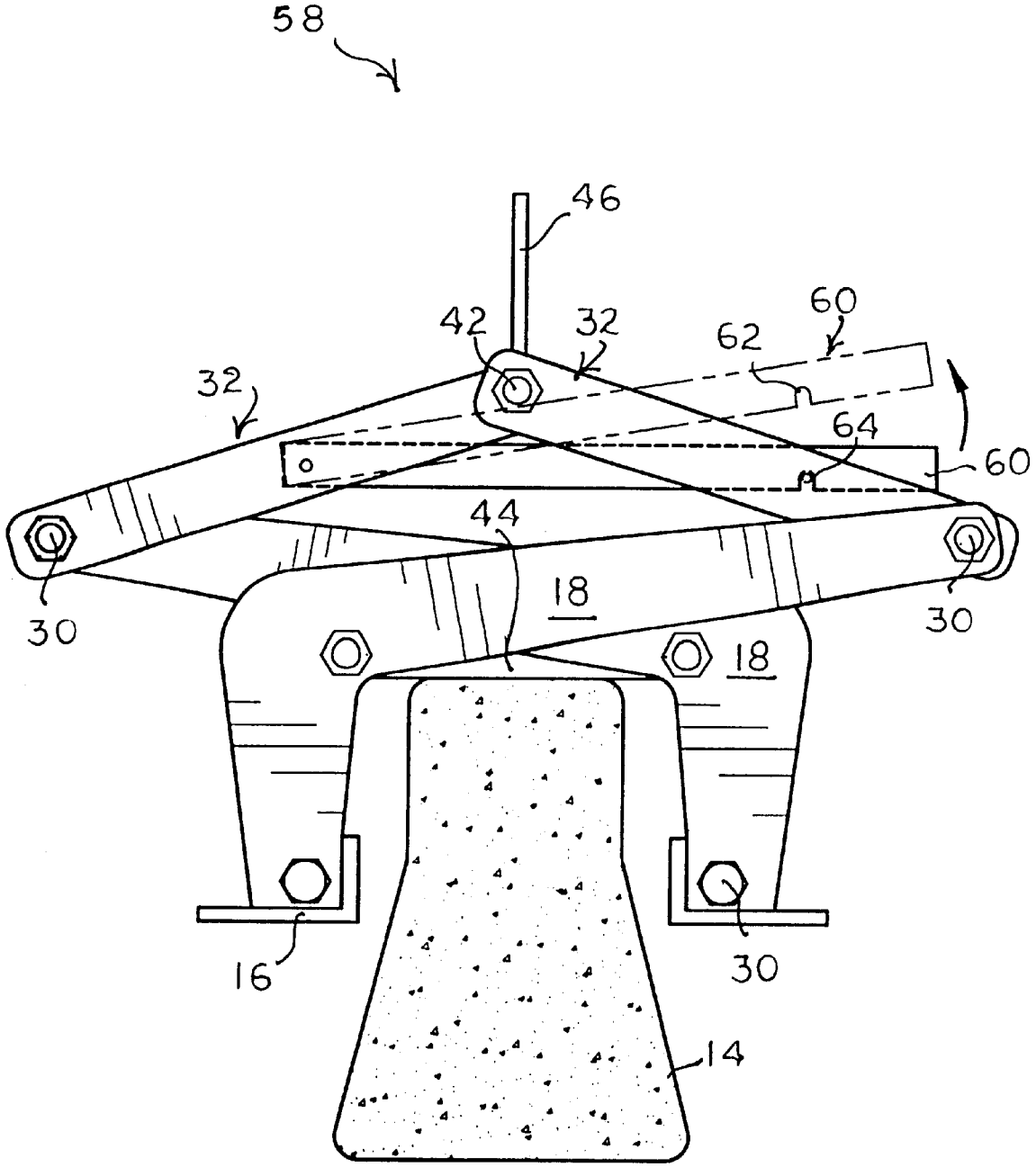
FIG. 3 is a side elevational view of a second embodiment of a barrier lifter apparatus utilizing a semi-automatic mode.

A second embodiment of a semi-automatic lifter apparatus 58 is depicted in FIG. 3. A latching handle 60 having a notch 62 at one end is hinged to a central portion of one of the link members 32 at its opposite end. In an open position, the latching handle is positioned on a pin 64 on a link 32. When the lifter 58 rests on the barrier 14, the latching handle is unlocked by lifting up as shown in shadow lines. The barrier 14 is carried to a new location and lowered to the ground. The lifter apparatus 58 is collapsed, and the latching handle 60 is positioned on the pin 64 to maintain the lifter apparatus 58 in the open position.

It is to be understood that the present invention is not limited to the embodiments described above, but encompasses any and all embodiments within the scope of the following claims.

I claim:

1. A barrier lifter apparatus comprising;

a pair of right-angled jaw elements positioned horizontally to securely abut a concrete barrier with a vertical side thereof;

a pair of upright L-shaped tong members, wherein each tong member having a long leg, a juncture and a short leg having a distal end, said distal end connected to one of the right-angled jaw elements;

two pairs of straight link members, each having a proximate end and a distal end, pivotally connected at its distal end to a proximate end of each L-shaped tong member;

planar cross braces between each pair of link members;

each proximate end of a link member joined and connected by a pivot pin to a shackle;

three rods connecting the proximate and distal ends of each link member;

two rods connecting the juncture of each tong member; and a pair of crossbars attached pivotally between each juncture of each tong member, wherein one of each crossbar is positioned outside one juncture and the opposite end is positioned inside the other juncture;

whereby the concrete road barrier can be hoisted by the apparatus.

2. The apparatus according to claim 1, including a latching handle having a notch on one end and hinged to a central portion of one of the link members at its opposite end.

3. The apparatus according to claim 2, including a latching pin positioned on another link member for securing the notch of the latching handle.

4. The apparatus according to claim 1, including an actuator device depending from the rod joining the proximate ends of each pair of link members.

5. The apparatus according to claims 4, including a ratchet and cam in the actuator device for locking the apparatus in an open position.

* * * * *